US011371813B2

(12) United States Patent
Yorkston

(10) Patent No.: US 11,371,813 B2
(45) Date of Patent: Jun. 28, 2022

(54) PYROTECHNIC SYSTEM

(71) Applicant: INFO WISE LIMITED, Hong Kong (CN)

(72) Inventor: Simon Yorkston, Paris (FR)

(73) Assignee: INFO WISE LIMITED, Wanchai (HK)

( * ) Notice: Subject to any disclaimer, the term of this patent is extended or adjusted under 35 U.S.C. 154(b) by 64 days.

(21) Appl. No.: 16/626,558

(22) PCT Filed: Jun. 22, 2018

(86) PCT No.: PCT/AU2018/050628
§ 371 (c)(1),
(2) Date: Dec. 25, 2019

(87) PCT Pub. No.: WO2019/000023
PCT Pub. Date: Jan. 3, 2019

(65) Prior Publication Data

US 2020/0248995 A1 Aug. 6, 2020

(30) Foreign Application Priority Data

Jun. 29, 2017 (AU) ..... 2017902523

(51) Int. Cl.

| | |
|---|---|
| ***F42B 4/06*** | (2006.01) |
| ***F42D 1/045*** | (2006.01) |
| *F41A 19/58* | (2006.01) |
| *F42B 4/24* | (2006.01) |
| *F42B 4/30* | (2006.01) |
| *F42B 12/56* | (2006.01) |

(52) U.S. Cl.
CPC ..... *F42B 4/06* (2013.01); *F42D 1/045* (2013.01); *F41A 19/58* (2013.01); *F42B 4/24* (2013.01); *F42B 4/30* (2013.01); *F42B 12/56* (2013.01)

(58) Field of Classification Search
CPC .... F42B 4/06; F42B 4/24; F42B 12/56; F42C 5/00; F42C 5/02; F42D 1/045
USPC ..... 102/361, 263
See application file for complete search history.

(56) References Cited

U.S. PATENT DOCUMENTS 3,470,419 A * 9/1969 Sitler ..... F42C 15/40 361/251
5,157,222 A * 10/1992 La Mura ..... F41A 19/68 102/217

(Continued)

OTHER PUBLICATIONS

Search Report and Written Opinion for International Patent Application No. PCT/AU2018/050628; dated Jul. 26, 2018.

*Primary Examiner* — Bret Hayes
(74) *Attorney, Agent, or Firm* — Barnes & Thornburg LLP; Jason Bernstein

(57) ABSTRACT

A pyrotechnic projectile, an electronic controller for a pyrotechnic projectile, and a method of controlling a pyrotechnic projectile are provided. The pyrotechnic projectile comprises: a burst charge, configured to provide an a visual and/or audible effect upon activation thereof; an electronic match configured to activate the burst charge; and an electronic controller, coupled to the electronic match. The electronic controller is configured to determine an altitude of the pyrotechnic projectile and cause the electronic match to activate the burst charge at least in part according to the altitude of the pyrotechnic projectile.

16 Claims, 4 Drawing Sheets

(56) References Cited

U.S. PATENT DOCUMENTS

| | | | | |
|---|---|---|---|---|
| 7,249,730 | B1 * | 7/2007 | Flippen, Jr. | F41G 7/346 244/3.1 |
| 2005/0217526 | A1 | 10/2005 | Gerardi | |
| 2006/0086277 | A1 | 4/2006 | Bossarte et al. | |
| 2009/0145321 | A1 * | 6/2009 | Russell | F42B 4/00 102/215 |
| 2010/0258022 | A1 * | 10/2010 | McKinley | F42B 4/06 102/335 |
| 2012/0138319 | A1 * | 6/2012 | Demmitt | A62C 8/005 169/28 |
| 2013/0048317 | A1 * | 2/2013 | Charlton | F42B 12/50 169/46 |
| 2018/0066927 | A1 * | 3/2018 | Wu | F42B 4/24 |

* cited by examiner

PYROTECHNIC SYSTEM

PRIORITY CLAIM

This patent application is a U.S. National Phase of International Patent Application No. PCT/AU2018/050628, filed 22 Jun. 2018, which claims priority to Australian Patent Application No. 2017902523, filed 29 Jun. 2017, the disclosures of which are incorporated herein by reference in their entireties.

TECHNICAL FIELD

The present invention relates to pyrotechnics. In particular, the present invention relates to fireworks in the form of pyrotechnic projectiles, and displays thereof.

BACKGROUND ART

Fireworks are often used to provide entertainment, and commonly as part of a fireworks display, which incorporates the effects produced by a plurality of fireworks and at different times.

A modern trend in fireworks displays is to utilise precise coordination of each of the fireworks to provide highly choreographed displays. In some cases, the fireworks are also synchronised with music, light shows, or other non-pyrotechnic events. As a result, there is a strong desire to have high precision fireworks.

Generally, pyrotechnical precision of airborne fireworks is governed by three elements: launch time, burst time, and burst altitude. Launch time is often controlled electronically, which can be very precise. However, burst time and burst altitude is generally controlled chemically.

FIG. 1 illustrates a cross section of a pyrotechnical projectile in the form of a firework 100, according to the prior art.

The firework 100 is coupled to an electronic match 105, also referred to as an 'e-Match', which is used to ignite a main fuse 110 of the firework. The electronic match 105 converts an electrical impulse, e.g. from a control system, into heat, and thus ignition of the main fuse 110.

The main fuse 110 extends around a body of the firework 100 and ignites a lift charge 115. The lift charge 115 comprises black powder, which when ignited, provides a combustion reaction which propulses (lifts) the firework 100 into the air.

As the lift charge 115 is ignited, a charge fuse 120, which is located partially within the lift charge 115, is also ignited. The charge fuse 120 extends from the lift charge 115 into a central portion of the firework 100 to a burst charge 125.

The burst charge 125 provides a combustion reaction which ignites and projects a plurality of display charges 130. The display charges 130 comprise combustible elements that, when ignited, provide a visual/audible effect.

The fuses 110, 120 are generally designed and calibrated to provide a desired burst time and burst altitude. In particular, the fuses 110, 120 are designed such that their rates of chemical reaction are generally within thresholds required to received the desired burst time and burst altitude with reference to a launch time.

The fireworks 100 of the prior art have several limitations, however, as outlined below.

Firstly, as the burst time and burst altitude is based upon chemical reactions, each element is susceptible to variation. For example, a burn rate of the fuses 110, 120 may vary due to variations in the chemical composition of black powder of the fuse, variations in packing, and variations in the length of the fuses. Similarly, the burst altitude varies based upon an amount of black powder in the lift charge 115 and its chemical composition.

These variations, even if minor, can result in large variations in trajectories, burst heights, and burst times of the fireworks 100. As a result, it is difficult to consistently synchronise the fireworks, which can be particularly obvious when many simultaneously triggered pyrotechnical charges, burst at different times and altitudes.

Furthermore, the fireworks 100 are based upon chemical chain reactions. As such, once the fireworks 100 are ignited, it is impossible to intervene or arrest the reaction. As a result, if any element in the fireworks 100 are incorrect or sub-optimal, several dangerous scenarios may develop.

A ground explosion is a dangerous scenario when the burst charge is triggered despite the lift charge not having been triggered. A ground explosion can trigger catastrophic mass explosion of neighbouring pyrotechnical charges, creating uncontrolled explosions and shrapnel, which is very dangerous to nearby operators.

A ground explosion can, for example, be caused by human error (e.g. incorrect installation of a pyrotechnical charge), or misfire (the main fuse 110 ignites the charge fuse 120 but not the lift charge 115.

A low explosion is another dangerous scenario, which is similar to a ground explosion but where the burst charge 125 triggers at a low altitude. This may be caused when insufficient propulsion is provided by the lift charge 115, for example.

A low explosion can trigger catastrophic mass explosion of neighbouring pyrotechnical charges creating uncontrolled explosions, shrapnel, as outlined above, but may even cause the display charges 130 to be propelled at towards the audience and dangerously explode close to people.

Delayed explosion is yet a further dangerous scenario, where the reaction of the fireworks is paused, and may restart at a later stage, up to 30 minutes after intended launch time. This can again trigger catastrophic mass explosion of neighbouring pyrotechnical charges, creating uncontrolled explosions, shrapnel, or cause the display charges 130 to be propelled at the fireworks operator or audience, especially during the disassembly post-spectacle.

This is obviously highly undesirable in the fireworks 100, and as such, there have been several attempts at reducing the risk of the abovementioned scenarios. These include additional safety procedures being implemented at fireworks displays and highly controlled fabrication, but none of these attempts have been particularly good at avoiding the problems mentioned above.

As such, there is clearly a need for an improved pyrotechnic system.

It will be clearly understood that, if a prior art publication is referred to herein, this reference does not constitute an admission that the publication forms part of the common general knowledge in the art in Australia or in any other country.

SUMMARY OF INVENTION

The present invention is directed to a pyrotechnic system, which may at least partially overcome at least one of the abovementioned disadvantages or provide the consumer with a useful or commercial choice.

With the foregoing in view, the present invention in one form, resides broadly in a pyrotechnic projectile comprising:

a burst charge, configured to provide an a visual and/or audible effect upon activation thereof;

an electronic match configured to activate the burst charge; and an electronic controller, coupled to the electronic match, the electronic controller configured to determine an altitude of the pyrotechnic projectile and cause the electronic match to activate the burst charge at least in part according to the altitude of the pyrotechnic projectile.

Advantageously, the pyrotechnic projectile provides improved accuracy in burst altitude to be provided, which in turn enables previously difficult or impossible pyrotechnical compositions to be achieved, such as the composition of images, text, logos, shapes through accurate coordination of multiple such pyrotechnic projectiles.

Furthermore, the pyrotechnic projectile provides improved safety, by preventing or reducing a risk of ground explosion, low explosions and delayed explosions. Furthermore, certain embodiments of the invention provide additional safety functionality, including test procedures performed by the controller, as outlined below.

Preferably, the pyrotechnic projectile further includes:

a lift charge configured to propulse the pyrotechnic projectile, and a further electronic match configured to activate the lift charge;

wherein the electronic controller is coupled to the further electronic match and cause the further electronic match to activate the lift charge.

The controller may be configured to activate the lift charge upon receipt of a launch signal. The controller may be electrically coupled to a control system from which the launch signal may be received.

Preferably, the pyrotechnic projectile includes one or more display charges, associated with the burst charge, and configured to provide the visual and/or audible effect.

Preferably, the lift charge comprises black powder. Preferably, the burst charge comprises black powder.

The controller may include a microcontroller, an altitude sensor and a power source.

The power source may comprise a battery and/or a capacitor.

The altitude sensor may comprise a barometric pressure sensor.

The controller may include a global positioning sensor, configured to determine altitude.

The controller may be configured to poll the altitude sensor, determined whether the altitude of the firework is above a predefined threshold, and activate the electronic match when the altitude is above the predefined threshold. Suitably, the controller is configured to poll the altitude sensor several times per second.

The controller may include a predefined burst altitude, and be configured to activate the burst charge at least in part according to the altitude of the pyrotechnic projectile with reference to the predefined burst altitude.

The controller may be configured to receive a burst altitude on a data interface, and be configured to activate the burst charge at least in part according to the altitude of the pyrotechnic projectile with reference to the received burst altitude.

The pyrotechnic projectile may be configurable to function in a timing mode, where the electronic match is configured to activate after an input time.

Preferably, the controller is configured to receive a test signal, and test the pyrotechnic projectile upon receipt of the test signal.

Suitably, the test signal comprises an impulse less than 0.3 A. The launch signal may comprise an impulse greater than 0.3 A.

The testing may comprise testing of the electronic match(es) and/or sensor(s). The testing may include continuity testing, resistance testing, and sensor data testing.

The controller may be configured to deactivate the firework if the testing of the pyrotechnic projectile fails.

In another form, the invention resides broadly in a method of controlling a pyrotechnic projectile, the method comprising:

determining, using an electronic controller, an altitude of the pyrotechnic projectile;

causing, using the electronic controller, an electronic match of the pyrotechnic projectile to activate a burst charge of the pyrotechnic projectile at least in part according to the altitude of the pyrotechnic projectile, wherein the burst charge is configured to provide an a visual and/or audible effect upon activation thereof.

In yet another form, resides broadly in an electronic controller for a pyrotechnic projectile, the electronic controller configured to:

determine an altitude of the pyrotechnic projectile; and cause an electronic match of the pyrotechnic projectile to activate a burst charge of the pyrotechnic projectile at least in part according to the altitude of the pyrotechnic projectile, wherein the burst charge is configured to provide an a visual and/or audible effect upon activation thereof.

The electronic controller may have an electrical output, configured to be coupled to the electronic match of the pyrotechnic projectile.

The electronic controller may be provided for use with a variety of types of fireworks. The electronic controller may be pre-manufactured, and incorporated into the pyrotechnic projectile at the time of manufacture thereof.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
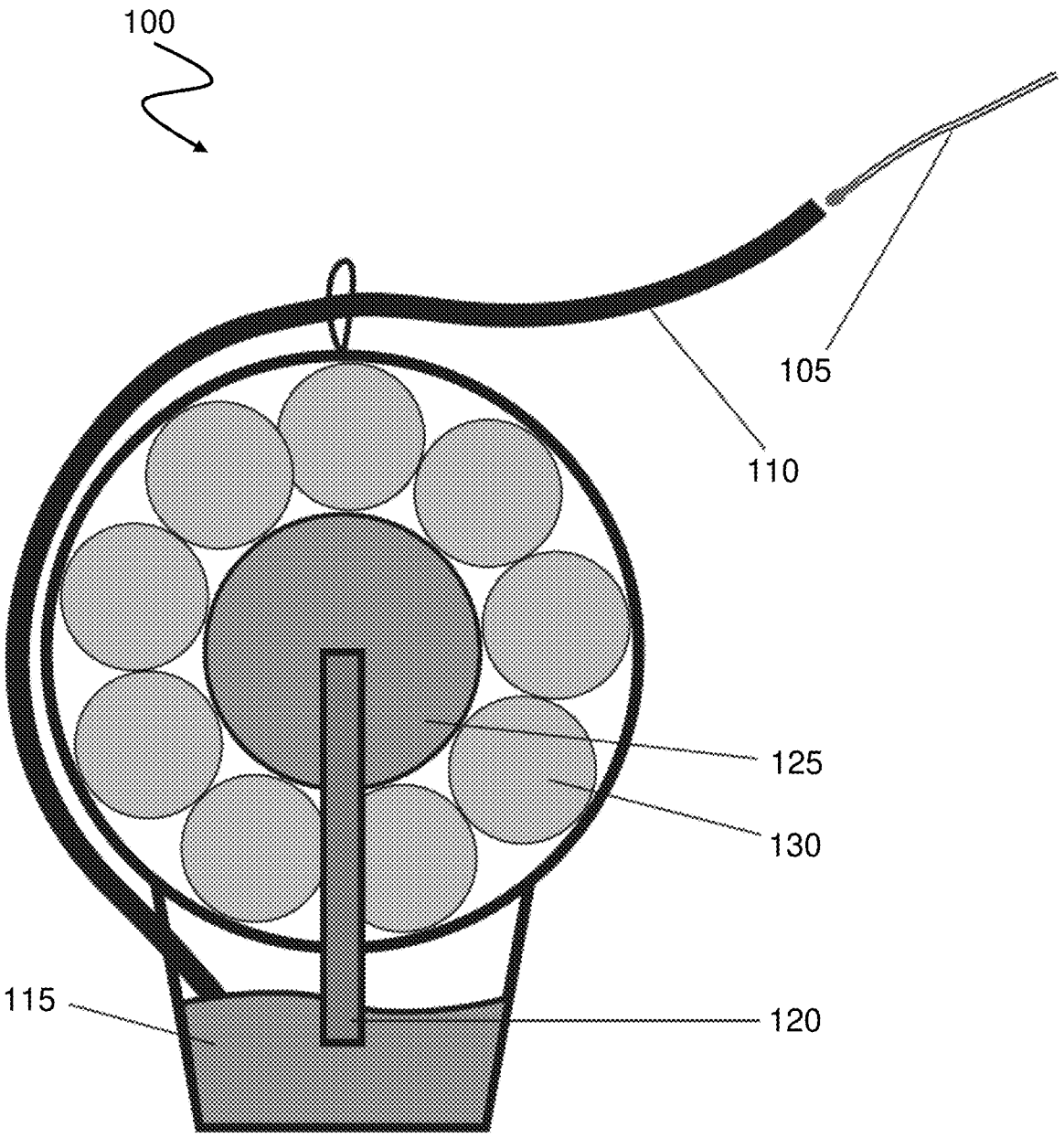
Figure 1 PRIOR ART
FIG. 1 illustrates a cross section of a pyrotechnical charge in the form of a firework, according to the prior art.
Figure 2:
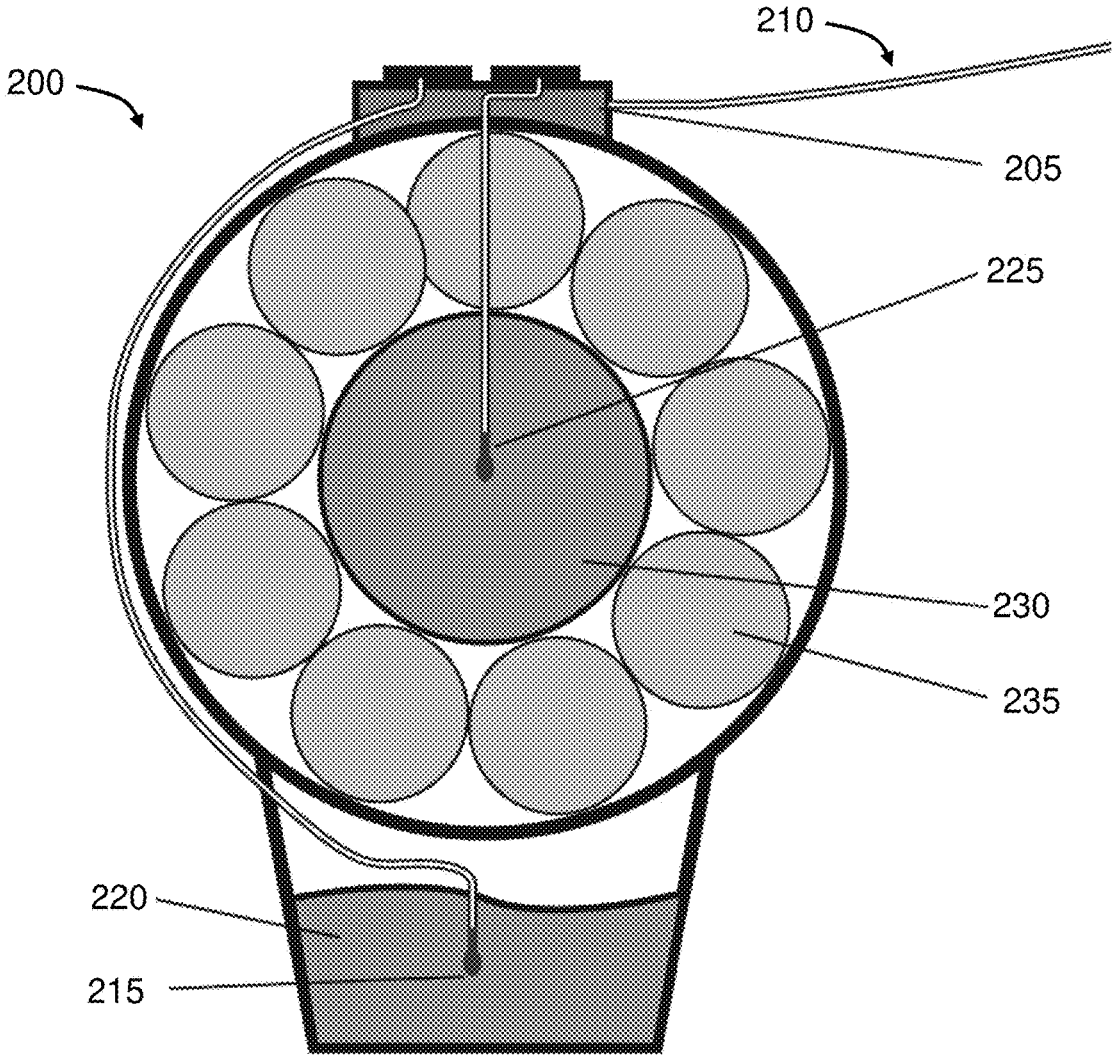
FIG. 2 illustrates a cross section of a pyrotechnic projectile in the form of a firework, according to an embodiment of the present invention.

FIG. 2 illustrates a cross section of a pyrotechnic projectile in the form of a firework 200, according to an embodiment of the present invention. Advantageously, the firework 200 enables more complex coordination with other fireworks, and is safer than prior art fireworks.

The firework 200 includes an electronic controller 205, comprising an input 210 which is coupled to a control system (not illustrated). The controller 205 is configured to receive a signal from the control system and either a) test the firework, or b) control launch and detonation of the firework.

As outlined in further detail below, the controller 205 comprises a collection of electronic components that work in symphony to provide the safety and advanced control features of the fireworks. These include a microcontroller with a precise internal timer, and an altitude sensor for determining altitude of the firework.

The controller 205 is electrically coupled to a first electronic match ('e-Match') 215, which is located in a lift charge 220 of the firework 200. The first electronic match 215 is used to ignite the lift charge when triggered by the controller 205.

The controller 205 is also electrically coupled to a second electronic match ('e-Match') 225, which is located in a burst charge 230 of the firework 200. The second electronic match 225 is used to ignite the burst charge when triggered by the controller 205.

The lift charge 220 comprises black powder, much like the lift charge of the firework 100, which when ignited provides combustion which propulses (lifts) the firework 200 into the air.

Similarly, the burst charge 230 provides combustion reaction, much like the burst charge of the firework 100, that ignites and projects a plurality of display charges 235. The display charges 235, when ignited, provide a visual and/or audible effect, such as a colour and/or crackling effect.

As the controller 205 controls the lift charge 220 and the burst charge 230 through electronic matches 215, 225, activation of the lift charge 220 is independent of activation of the burst charge 230. As such, should there be an error in activating the lift charge 220, for example, the controller 205 will not activate the burst charge 230. Furthermore, through independent control of the lift charge 220 and the burst charge 230, greater accuracy can be achieved in timing and/or positioning (i.e. burst time and/or burst altitude) of the firework 200.

Figure 3:
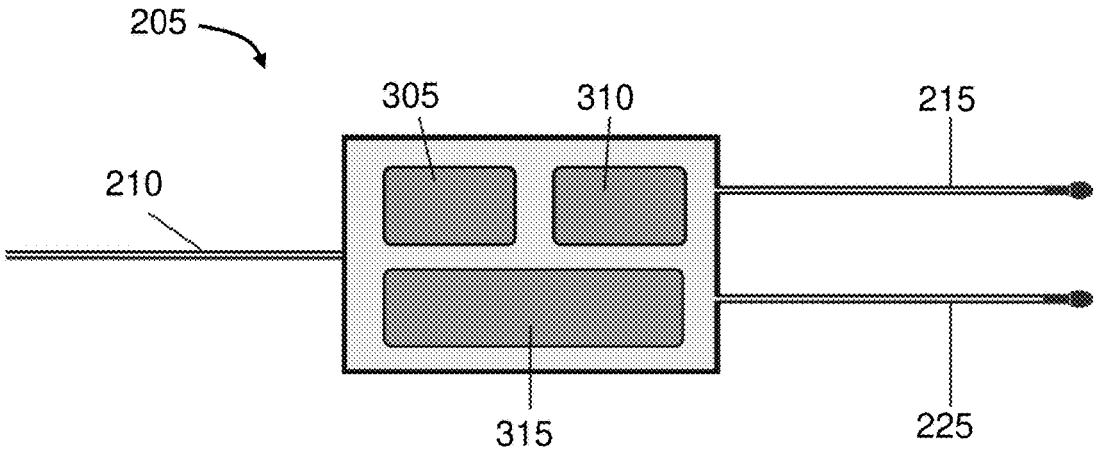
FIG. 3 illustrates a schematic of a controller of the firework of FIG. 2, according to an embodiment of the present invention.

FIG. 3 illustrates a schematic of the controller 205 of the firework 200, according to an embodiment of the present invention.

The controller 205 includes a microcontroller 305, an altitude sensor 310 and a power source 315. The altitude sensor 310 and the power source 315 are coupled to the microcontroller 305, as are the input 210 and the first and second electronic matches 215, 225.

The microcontroller 305 is configured to initially receive a trigger from the input 210, which may comprise an electrical signal within certain predefined parameters. Upon receipt of such signal, the microcontroller may determine the type of signal (e.g. test or launch signal), and perform an appropriate action based thereon.

In one embodiment, the test signal is defined by an electrical impulse of less than 0.3 A, and the launch signal is defined by an electrical impulse of greater than 0.3 A. However, any suitable signalling may be used.

In case of a launch signal, the microcontroller 305 activates the lift charge by activating the first electronic match 215. This causes the firework 200 to be launched into the air.

At this time, launch tests may be performed to detect any errors with the launch. For example, it may be determined whether the lift charge electronic match 215 fired (as expected), or one or more other tests may be performed. In case an error is detected, the microcontroller 305 may deactivate the firework 200.

Otherwise, the microcontroller 305 starts polling the altitude sensor 310, and determined whether the altitude of the firework is above a predefined threshold. When the altitude is above the predefined threshold, the microcontroller 305 activates the burst charge by activating the second electronic match 225. This causes the firework 200 to burst, and provide a visual and/or audible effect.

As an illustrative example, the firework 200 may be configured to burst at an altitude of 200 m, and as such, the predefined threshold is 200 m. The microcontroller 305 polls the altitude sensor 310, and determines when the altitude is above this threshold.

If the microcontroller 305 polls the altitude sensor 310 at a sufficiently high rate, high accuracy can be achieved in relation to burst altitude. Preferably, the microcontroller 305 is configured to poll the altitude sensor 310 several times per second.

The altitude sensor 310 may comprise any suitable sensor or component, or collection thereof, which allows altitude to be estimated or determined.

As an illustrative example, a barometric sensor may be used, which allows the microprocessor 305 to estimate an altitude according to air pressure. Alternatively or additionally, a global positioning system (GPS) sensor may be used, allowing the microprocessor 305 to calculate altitude based off GPS signal data.

The skilled addressee will readily appreciate that the altitude sensor 310 may be used together with other data of the firework 200. For example, a trajectory of the firework may be determined according to speed and directional data and timing, and used together with an altitude sensor to provide more accurate data, and/or to detect inconsistencies in the data thereof.

As an illustrative example, the firework 200 may include one or more speed sensors, accelerometers, axis sensors, or the like, which may be provided as an integrated sensor package where data is combined, or as individual sensors coupled to the microprocessor 305.

The power source 315 may comprise any suitable component, or collection thereof, capable of providing an electronical charge. The power source 315 supplies electricity the microcontroller 305, and is used to activate the first and second electronic matches 215, 225.

In one embodiment, the power source 315 comprises a capacitor, which enables high electrical performance, together with rapid charging and discharging of electricity. In such case, the capacitor may be charged by the source 210, during a testing phase or otherwise. Alternatively or additionally, the power source may comprise a battery that is pre-charged.

In some embodiments, the fireworks are pre-configured. In such case, the target altitude (i.e. the thresholds) may be set at manufacture. In other embodiments, the firework 200 is configurable (programmable).

In particular, the microcontroller 305 may be programmed via the input wire 210. In particular, the microcontroller 305 may include a memory including a desired burst altitude, as well as other desired characteristics of the firework 200. A computer may then be used to adjust the data of the memory to thus control characteristics of the firework 200.

In one embodiment, the firework 200 may be configurable to function in a timing mode, where the second electronic match 225 is configured to activate after an input time, and an altitude mode, whether the second electronic match 225 is configured to activate at a particular altitude.

This enables the firework 200 to be used together with other fireworks in different configurations. For example, when synchronising with other fireworks or music, the timing mode may be used. When creating complex patterns with several fireworks, such as words or images, altitude mode may be used.

As mentioned above, the firework 200 includes a testing configuration. In such case, self-testing of the microcontroller 305, and various sensors and electronic matches may be performed prior to use. Such testing may comprise continuity testing, resistance testing, and sensor data testing (e.g. comparing sensor data with expected data). For example, the microcontroller may send a small electrical impulse (typically less than 0.3 A) to test the presence and continuity of an e-match.

Figure 4:
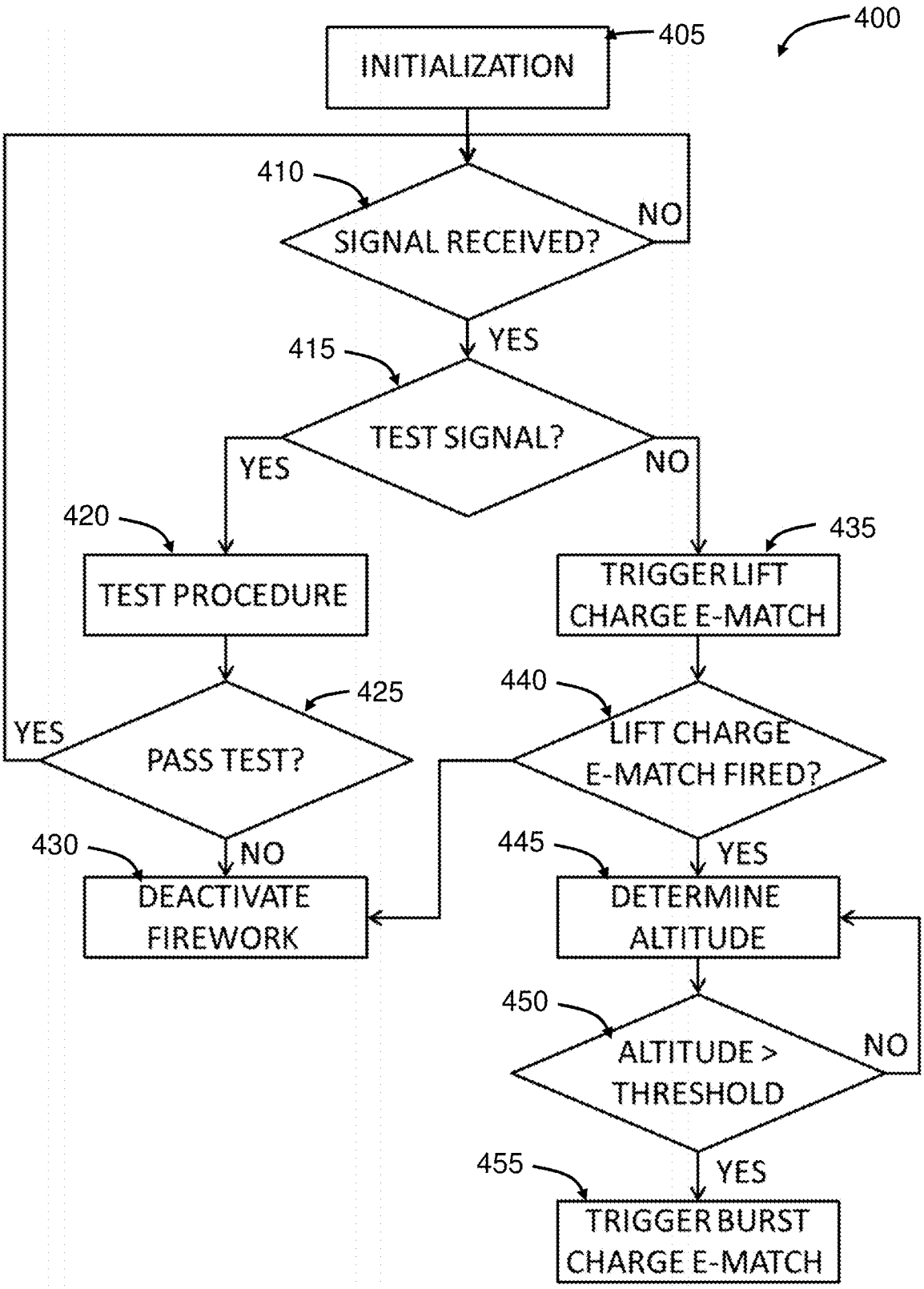
FIG. 4 illustrates a method of controlling a firework, such as the firework of FIG. 2, according to an embodiment of the present invention.

FIG. 4 illustrates a method of 400 of controlling a firework, according to an embodiment of the present invention. The method 400 may be performed by the microcontroller 305 of the firework 200.

At step 405, the firework 200 is initialised. This may comprise activating a data interface on which the signal data is received, activating the sensors, or any other suitable initialisation action.

The firework 200 then goes into a signal reception wait loop at step 410. In particular, the firework 200 determines whether a signal is received, and continues to determine same until a signal is received.

When a signal is received, it is determined whether the signal is a test signal in step 415. This may comprise determining whether the signal is greater or less than 0.3 A, as outlined above.

If the signal is a test signal, the test procedure is launched at step 420. The test procedure may comprise any suitable test procedure, and may include testing each of the sensors and electronic matches of the firework.

At step 425, it is determined whether the test was passed. If the test failed, the firework is deactivated. By deactivating the firework, the method 400 ensures that incorrect sensor data, or other errors in the firework, does not inadvertently cause the firework to explode.

If the test passed, the method continues at the signal reception wait loop at step 410, where the firework may later be tested again or activated (launched).

If the signal is not a test signal (and is a launch signal), the lift charge e-match is triggered, causing the firework to launch. It is then determined whether the lift charge e-match fired in step 440. In case it erroneously did not fire, the firework is deactivated in step 430.

In case the lift charge e-match fired in step 440 (i.e. the firework is working as expected), the firework goes into an altitude loop. In particular, the altitude is determined in step 445, and compared to a threshold in 450. If the altitude is lower than the threshold, the method loops back to step 445, where altitude is determined again.

When the altitude is greater than the threshold, the burst charge e-match is triggered at step 455, causing the firework to detonate.

Figure 5:
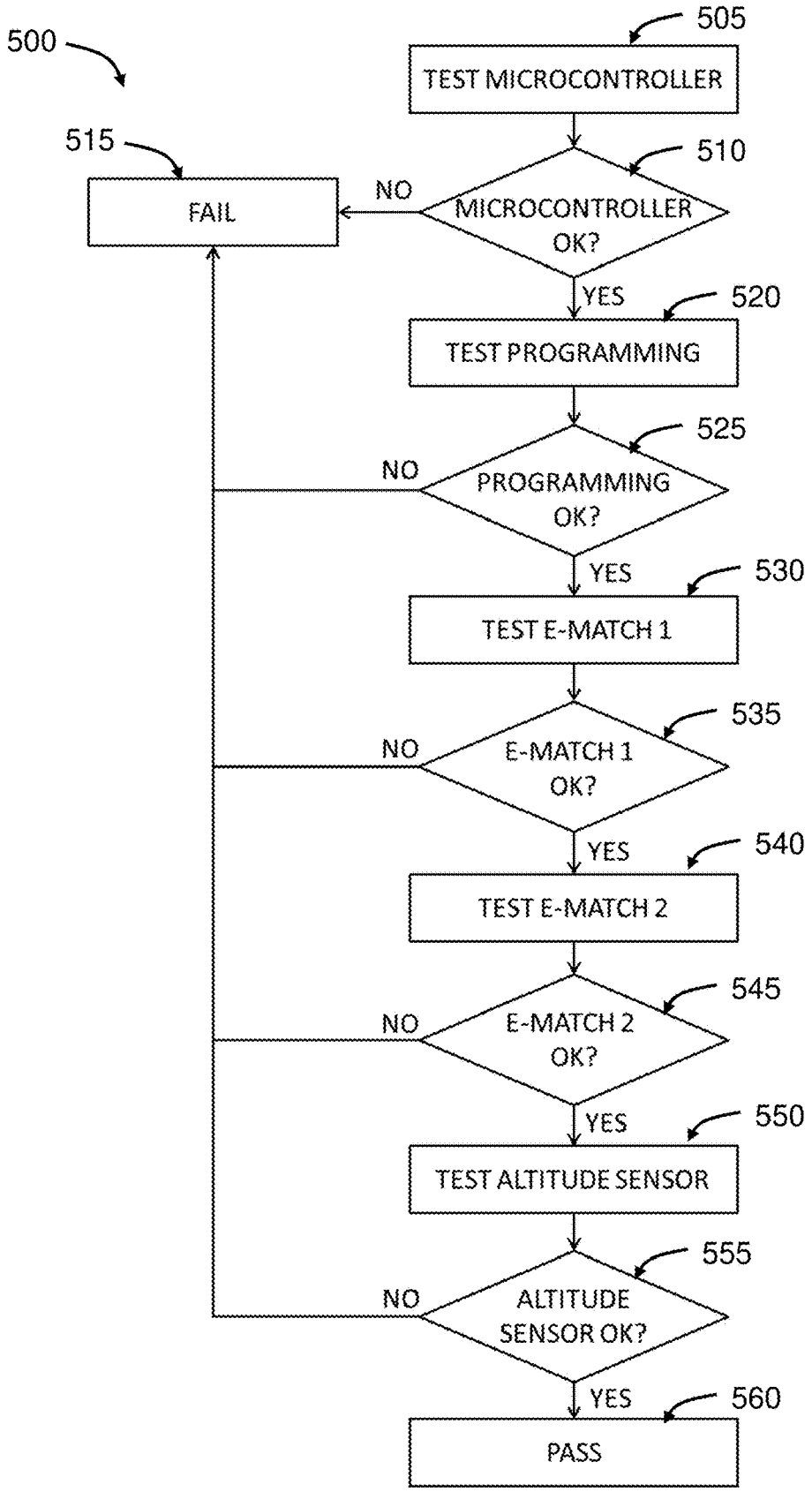
FIG. 5 illustrates a test method for testing a firework, such as the firework of FIG. 2, according to an embodiment of the present invention.

FIG. 5 illustrates a test method for testing a firework, such as the firework 200, according to an embodiment of the present invention. The test procedure may be performed on a microcontroller of the firework.

At step 505, a microcontroller of the firework is tested. If the microcontroller is performing the method, a self-test may be performed.

At step 510, it is determined whether the microcontroller is OK, i.e. whether the microcontroller passed the test. If not, the method 500 finishes at step 515, where a fail is reported. If the microcontroller is OK, the method 500 continues at step 520.

At step 520, programming of the firework is tested. The programming of the firework may be tested by determining whether all required parameters are configured, for example.

At step 525, it is determined whether the programming is OK, i.e. whether the test of step 520 was passed or not. If the test failed, the method 500 finishes at step 515, where a fail is reported. If the test passes, the method 500 continues at step 530.

At step 530, a first e-match of the firework is tested. The e-match may be tested by testing a continuity thereof, for example.

At step 535, it is determined whether the first e-match is OK, i.e. whether the test of step 530 was passed or not. If the test failed, the method 500 finishes at step 515, where a fail is reported. If the test passes, the method 500 continues at step 540.

At step 540, a second e-match of the firework is tested. The second e-match may be tested by testing a continuity thereof, for example.

At step 545, it is determined whether the second e-match is OK, i.e. whether the test of step 540 was passed or not. If the test failed, the method 500 finishes at step 515, where a fail is reported. If the test passes, the method 500 continues at step 550.

At step 550, an altitude sensor of the firework is tested. The altitude sensor may be tested by reading data thereof and comparing the read data to known thresholds, for example.

At step 555, it is determined whether the altitude sensor is OK, i.e. whether the test of step 550 was passed or not. If the test failed, the method 500 finishes at step 515, where a fail is reported. If the test passes, the method 500 finishes at step 560 where a pass is reported.

In the description above, test signals and launch signals are contemplated. The skilled addressee will readily appreciate that other signals may also be provided, including a programming signal. The signals may be explicitly defined (e.g. by a particular electrical pattern or structure), or implicitly defined.

While the fireworks and methods described above have related to determining an altitude and triggering the burst of the firework based thereon, the skilled addressee will readily appreciate that more complex configurations may be provided, where the burst of the firework may be triggered upon one of potentially many criterion.

For example, the firework may be configured to burst at a particular altitude or after a particular time, whichever comes first. Alternatively, the firework may be configured to burst when both an altitude is reached and a timer has passed a predefined time limit.

Furthermore, the firework may be configured to determine an altitude in two or more ways, and activate a burst match of the firework only if an altitude threshold is reached, and the altitude is consistent across the two or more altitude measurements.

According to certain embodiments, the fireworks may include other components or hardware coupled to the microcontroller. For example, the fireworks may include status indicators, such as lights, warning buzzers, etc, other types of sensors for measuring data when in use, such as speed sensors, accelerometers and axis sensors, charging ports, configuration ports, buttons and the like.

The fireworks and method described above are advantageously compatible with these existing control systems. As such, fireworks according to embodiments of the present invention may be implemented on control systems without requiring any additional hardware or modifications.

Advantageously, the fireworks and methods described above enable high precision burst control and synchronisation. In particular, embodiments of the invention enable the fireworks to burst accurately at pre-determined altitudes, which in turn enables multiple fireworks to act in concert to produce previously impossible spectacles, including depicting images, logos, and text in the sky.

This functionality allows enables coordination and synchronisation of fireworks in manners not previously possible.

Furthermore, the fireworks and methods described above enable additional safety over prior art fireworks. For example, in case of a problem with the launch charge, the firework is able to detect that it has not reached its configured height, and as such, will not explode. In prior art systems, the firework will explode after a predetermined time (e.g. determined by the fuses or otherwise), regardless of whether the firework has reached a safe height.

Furthermore, the testing procedures described above enable the fireworks to be deactivated (or stopped if launched).

As a result, the risk of ground explosions, low explosions, and delayed explosions are drastically reduced.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A pyrotechnic projectile comprising:

a lift charge configured to propel the pyrotechnic projectile;

a burst charge, configured to provide a visual and/or audible effect upon activation thereof;

a first electronic match configured to activate the lift charge:

a second electronic match configured to activate the burst charge; and an electronic controller, coupled to the first electronic match and the second electronic match, including an altitude sensor configured to measure an altitude of the pyrotechnic projectile, wherein the controller is configured to cause the first electronic match to activate the lift charge, and wherein the controller is configured to poll the altitude sensor to determine when the altitude of the pyrotechnic projectile is above a predefined threshold altitude and cause the second electronic match to activate the burst charge at least in part according to the altitude of the pyrotechnic projectile.

2. The pyrotechnic projectile of claim 1, wherein the controller is configured to activate the lift charge upon receipt of a launch signal.

3. The pyrotechnic projectile of claim 2, wherein the controller is electrically coupled to a control system from which the launch signal is received.

4. The pyrotechnic projectile of claim 1, wherein the pyrotechnic projectile includes one or more display charges, associated with the burst charge, and configured to provide the visual and/or audible effect.

5. The pyrotechnic projectile of claim 1, wherein the burst charge comprises black powder.

6. The pyrotechnic projectile of claim 1, wherein the controller incudes a microcontroller and a power source.

7. The pyrotechnic projectile of claim 6, wherein the power source comprises at least one of a battery and a capacitor.

8. The pyrotechnic projectile of claim 6, wherein the altitude sensor comprises a barometric pressure sensor.

9. The pyrotechnic projectile of claim 1, wherein the controller is configured to activate the second electronic match when the measured altitude of the projectile is above the predefined threshold altitude.

10. The pyrotechnic projectile of claim 9, wherein the controller includes a predefined burst altitude, and is configured to activate the burst charge at least in part according to the altitude of the pyrotechnic projectile with reference to the predefined burst altitude.

11. The pyrotechnic projectile of claim 9, wherein the controller is configured to receive a burst altitude on a data interface, and the controller is configured to activate the burst charge at least in part according to the altitude of the pyrotechnic projectile with reference to the received burst altitude.

12. The pyrotechnic projectile of claim 1, wherein the pyrotechnic projectile is configurable to function in a timing mode, where the second electronic match is configured to activate after an input time.

13. The pyrotechnic projectile of claim 1, wherein the controller is configured to receive a test signal, and to test the pyrotechnic projectile upon receipt of the test signal.

14. The pyrotechnic projectile of claim 13, wherein the controller is configured to deactivate the burst charge if the testing of the pyrotechnic projectile fails.

15. A method of controlling a pyrotechnic projectile, the method comprising:

using an electronic controller to cause a first electronic match of the pyrotechnic projectile to activate a lift charge of the pyrotechnic projectile to propel the pyrotechnic projectile;

measuring an altitude of the pyrotechnic projectile with an altitude sensor;

polling the altitude sensor to determine whether the altitude of the pyrotechnic projectile is above a threshold altitude;

using the electronic controller to cause a second electronic match of the pyrotechnic projectile to activate a burst charge of the pyrotechnic projectile at least in part according to the measured altitude of the pyrotechnic projectile, causing the burst charge to provide a visual and/or audible effect upon activation thereof.

16. A pyrotechnic projectile comprising:

a lift charge configured to propel the pyrotechnic projectile;

a burst charge, configured to provide a visual and/or audible effect upon activation thereof;

a first electronic match configured to activate the lift charge:

a second electronic match configured to activate the burst charge; and an electronic controller, coupled to the first electronic match and the second electronic match, including an altitude sensor configured to measure an altitude of the pyrotechnic projectile wherein the controller is configured to cause the first electronic match to activate the lift charge, and wherein the controller is configured to poll the altitude sensor to determine whether the altitude of the pyrotechnic projectile is above a predefined threshold altitude and cause the second electronic match to activate the burst charge at least in part according to the altitude of the pyrotechnic projectile, and wherein the altitude sensor is a barometric pressure sensor mounted on the projectile configured to send the altitude measurements to the controller.

* * * * *